US011633757B2

(12) United States Patent
Renwick et al.

(10) Patent No.: US 11,633,757 B2
(45) Date of Patent: Apr. 25, 2023

(54) APPARATUS AND METHODS FOR USE IN APPLYING A FLUID TO A SURFACE

(71) Applicant: THE BOEING COMPANY, Chicago, IL (US)

(72) Inventors: Zachary B. Renwick, St. Louis, MO (US); Zachary L. Green, Edwardsville, IL (US); Camille D. Carter, St. Louis, MO (US); Daniel D. Bloch, St. Peters, MO (US)

(73) Assignee: The Boeing Company, Chicago, IL (US)

( * ) Notice: Subject to any disclaimer, the term of this patent is extended or adjusted under 35 U.S.C. 154(b) by 19 days.

(21) Appl. No.: 17/359,809

(22) Filed: Jun. 28, 2021

(65) Prior Publication Data

US 2021/0323025 A1 Oct. 21, 2021

Related U.S. Application Data

(62) Division of application No. 15/624,021, filed on Jun. 15, 2017, now Pat. No. 11,077,461.

(51) Int. Cl.
*B05D 1/28* (2006.01)
*B05C 1/00* (2006.01)
(Continued)

(52) U.S. Cl.
CPC ..... *B05D 1/28* (2013.01); *B05C 1/00* (2013.01); *B05C 1/025* (2013.01); *B05C 1/06* (2013.01);
(Continued)

(58) Field of Classification Search
None
See application file for complete search history.

(56) References Cited

U.S. PATENT DOCUMENTS 4,961,661 A 10/1990 Sutton
5,354,379 A * 10/1994 Milbourn ..... B41M 7/0045 15/100
(Continued)

FOREIGN PATENT DOCUMENTS

WO 9418604 A1 8/1994
WO 9913992 A1 3/1999
(Continued)

OTHER PUBLICATIONS

European Search Report regarding European Patent Application No. 18 170 342.2 dated Nov. 13, 2018; pp. 1-4.
(Continued)

*Primary Examiner* — Michael P. Rodriguez
(74) *Attorney, Agent, or Firm* — Armstrong Teasdale LLP

(57) ABSTRACT

A fluid applicator for use in a fluid application system includes a base plate comprising at least one rail and a housing slidably coupled to the base plate. The fluid applicator also includes a plurality of fluid permeable pads positioned within the housing and a fluid delivery conduit coupled to the base plate and to the housing. The fluid applicator further includes an actuator configured to selectively move the housing and the plurality of pads along the rails between a first position and a second position. The plurality of fluid permeable pads are in flow communication with the fluid delivery conduit in the first position, and the plurality of fluid permeable pads are prevented from being in flow communication with the fluid delivery conduit in the second position.

15 Claims, 16 Drawing Sheets

(51) Int. Cl.

| | |
|---|---|
| ***B05C 11/10*** | (2006.01) |
| ***B05C 13/00*** | (2006.01) |
| ***B05C 1/06*** | (2006.01) |
| ***B05C 9/04*** | (2006.01) |
| ***B05C 1/02*** | (2006.01) |

(52) U.S. Cl.
CPC ..... *B05C 9/04* (2013.01); *B05C 11/1044* (2013.01); *B05C 13/00* (2013.01)

(56) References Cited

U.S. PATENT DOCUMENTS

| | | | |
|---|---|---|---|
| 5,934,296 | A | 8/1999 | Clay |
| 6,360,753 | B1 | 3/2002 | Vickers |
| 6,523,550 | B2 | 2/2003 | McCormick |
| 8,747,008 | B2 | 6/2014 | Geesbreght et al. |
| 2010/0168638 | A1 | 7/2010 | Korogi et al. |
| 2011/0197643 | A1 | 8/2011 | Bundy et al. |

FOREIGN PATENT DOCUMENTS

| | | | | |
|---|---|---|---|---|
| WO | 03022452 | A1 | 3/2003 | |
| WO | WO-03022452 | A1 * | 3/2003 | ..... B05C 1/06 |
| WO | 2017056617 | A1 | 4/2017 | |

OTHER PUBLICATIONS

Examination Report regarding European Patent Application No. 18 170 342.2 dated May 7, 2019; pp. 1-4.

* cited by examiner

APPARATUS AND METHODS FOR USE IN APPLYING A FLUID TO A SURFACE

CROSS-REFERENCE TO RELATED APPLICATIONS

This application is a divisional application of and claims priority to U.S. non-provisional patent application Ser. No. 15/624,021, filed Jun. 15, 2017, which is hereby incorporated by reference in its entirety.

BACKGROUND

The field of the disclosure relates generally to applying a fluid to a workpiece, and more specifically, to different apparatuses and systems for applying fluid to the workpiece.

At least some known manufacturing facilities include application systems that spray fluid onto a workpiece. However, spraying fluids results in large amounts of fluid waste and generates an excessive amount of flammable and toxic fumes. Such application systems also typically include pumps or valves through which the fluid is channeled. However, such components tend to have decreased chemical resistance, and they may also be potential sources of ignition for flammable fluids. Additionally, at least some know pumps and valves may agitate and froth the fluid as it is being channeled, which is undesirable.

Another known application method includes manual application of the fluid by one or more technicians. A technician may dip a cloth into a vat of the fluid or spray the fluid onto a cloth and then wipe the cloth along the workpiece. While this method results in less waste fluid, the technicians are directly exposed to the fluid and its fumes. As such, this method may not be available for use with caustic fluids.

SUMMARY

In one aspect, a fluid applicator for use in a fluid application system is provided. The fluid applicator includes a base plate comprising at least one rail and a housing slidably coupled to the base plate. The fluid applicator also includes a plurality of fluid permeable pads positioned within the housing and a fluid delivery conduit coupled to the base plate and to the housing. The fluid applicator further includes an actuator configured to selectively move the housing and the plurality of pads along the rails between a first position and a second position. The plurality of fluid permeable pads are in flow communication with the fluid delivery conduit in the first position, and the plurality of fluid permeable pads are prevented from being in flow communication with the fluid delivery conduit in the second position.

In yet another aspect, a fluid application system is provided. The fluid application system includes a pair of fluid applicators including a first fluid applicator and a second fluid applicator. Each of the fluid applicators includes a base plate, a fluid delivery conduit coupled to the base plate, and a housing slidably coupled to the base plate between a first position and a second position. The housing includes a plurality of fluid permeable pads. The housing is selectively moveable to prevent fluid flow between the fluid delivery conduit and the plurality of fluid permeable pads in the first position and to couple the plurality of fluid permeable pads in fluid communication with the fluid delivery conduit in the second position. The fluid application system also includes a rail system including a guide rail. The first fluid applicator and the second fluid applicator are slidably coupled to the guide rail such that the first fluid applicator and the second fluid applicator are movable relative to each other to adjustably vary a distance therebetween to correspond to a thickness of a workpiece configured to be received between the first fluid applicator and the second fluid applicator.

In yet another embodiment, a method of applying a fluid to a workpiece using a fluid application system is provided. The method includes positioning a first fluid applicator and a second fluid applicator on a plane above a fluid storage tank, wherein the first fluid applicator and the second fluid applicator each include a fluid permeable pad. The method also includes coupling the first fluid applicator and the second fluid applicator in fluid communication with the storage tank with a fluid supply conduit and positioning the workpiece between the first fluid applicator and the second fluid applicator such that the workpiece contacts the fluid permeable pads. The method further includes pressurizing the fluid storage tank with high pressure air to channel fluid through the fluid supply conduit and into the first fluid applicator and the second fluid applicator.

The features, functions, and advantages that have been discussed can be achieved independently in various embodiments or may be combined in yet other embodiments, further details of which can be seen with reference to the following description and drawings.

DETAILED DESCRIPTION

The examples described herein facilitate applying a fluid to a workpiece using a fluid permeable pad saturated with the fluid. The fluid application system described herein includes a pair of identical, spaced apart, fluid applicators that each include a fluid permeable pad saturated with the fluid. In one implementation, each of the fluid applicators also includes a pair of fluid delivery conduits coupled to a base plate, wherein each fluid delivery conduit includes a slot defined therein configured to receive an opposing end of the fluid permeable pad. In another embodiment, each fluid applicator defines a fluid reservoir between adjacent plates and channels fluid from the reservoir though openings in the plate to the fluid permeable pad. In yet another implementation, each of the fluid applicators includes a base plate, a fluid delivery conduit coupled to the base plate, and a housing slidably coupled to the base plate between a first position and a second position. The housing includes a plurality of fluid permeable pads and is moveable to selectively prevent fluid flow between the fluid delivery conduit and the plurality of fluid permeable pads in the first position or to couple the plurality of fluid permeable pads in fluid communication with the fluid delivery conduit in the second position.

The fluid application systems described herein provide a safe, controlled method of applying a fluid to both sides of a workpiece that does not generate the fluid waste associated with other known methods of fluid applications, such as spraying. The systems described herein use air pressure supply the fluid permeable pads with an optimum amount of fluid and gravity is used to drain any remaining fluid from the fluid applicators back into the storage tank. Additionally, the fluid application systems described herein do not channel the fluid through any pumps or valves, which enable the use of volatile and/or corrosive fluids without the risk of causing corrosion and/or creating a potential source of ignition in the pump or valve. Moreover, in the systems described herein application of the fluid to the workpiece does not require a technician to handle the fluid or to be near enough to breathe in the fluid vapors, thus providing a safer working environment.

Figure 1:
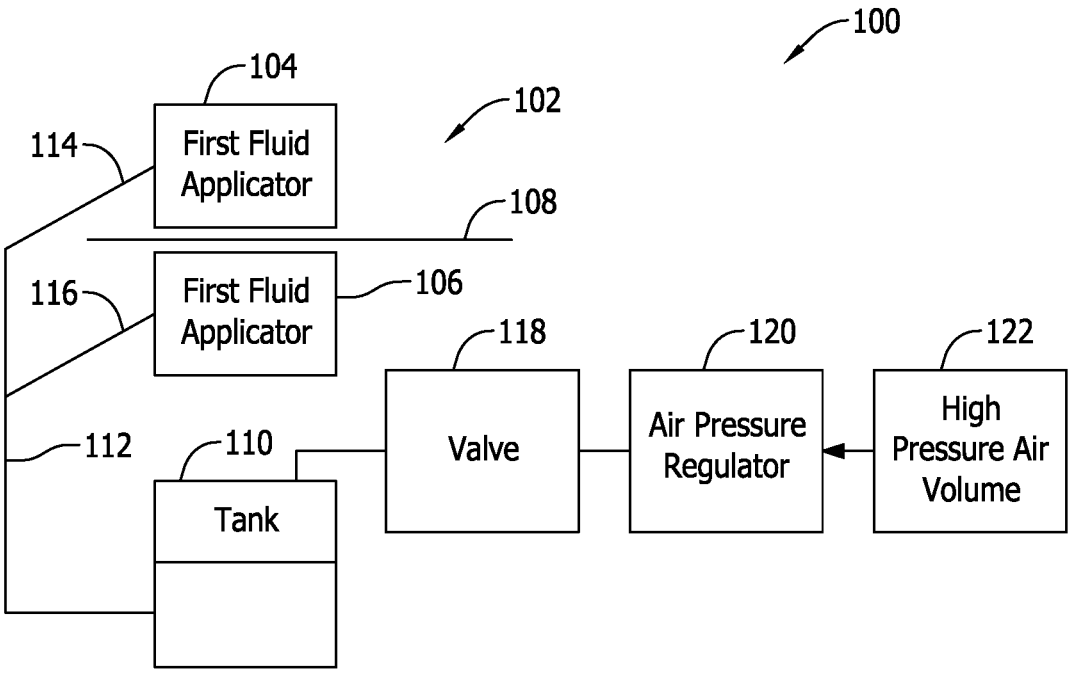
FIG. 1 is a schematic diagram of a fluid application system.

Referring to the drawings, FIG. 1 is a schematic diagram of a fluid application system 100 that includes a pair of fluid applicators 102 including a first fluid applicator 104 and a second fluid applicator 106. Fluid applicators 102 are spaced a distance apart such that a workpiece 108 is positioned therebetween. Fluid application system 100 also includes a fluid storage tank 110 for storing a fluid supply and a main fluid supply conduit 112 extending from fluid storage tank 110. A first secondary fluid conduit 114 extends between main fluid supply conduit 112 and first fluid applicator 104. Similarly, a second secondary fluid conduit 116 extends between main fluid supply conduit 112 and second fluid applicator 106. In the exemplary implementation, applicators 100 are positioned on a plane above fluid storage tank 110 such that both secondary fluid conduits 114 and 116 are obliquely oriented with respect to main fluid supply conduit 112 and a respective fluid applicator 102. More specifically, both secondary fluid conduits 114 and 116 are angled downwards, away from applicators 102 to allow any fluid therein to drain toward fluid storage tank 110 when system is not in use. In the exemplary implementation, application system 100 also includes an air valve 118 and an air regulator 120 that work in combination to control a flow 122 of high pressure air to fluid storage tank 110.

In operation, airflow 122 is channeled through regulator 120 and valve 118 at a desired rate to pressurize fluid storage tank 110. At a predetermined pressure, fluid stored within fluid storage tank 110 is pushed up main fluid supply conduit 112 to secondary fluid conduits 114 and 116, and finally into applicators 102. Regulator 120 and valve 118 control the amount of airflow 122 supplied to fluid storage tank 110, and therefore control the amount of fluid supplied to applicators 102. If it is determined that applicators 102 require additional fluid to apply to workpiece 108, regulator 120 and valve 118 are adjusted to increase the amount of airflow 122 supplied to fluid storage tank 110 to push more fluid into fluid conduits 112, 114, and 116. When it is desired to cease operation of application system 100, valve 118 is closed and fluid storage tank 110 depressurizes. Because of the downward angle of second fluid conduits 114 and 116, gravity causes fluid remaining therein is drained into main fluid conduit 112 and channeled back into fluid storage tank 110 for future use. Recapturing the fluid within fluid conduits 112, 114, and 116 reduces the amount of fluid lost to evaporation or conduit purging and therefore reduces the operating costs of application system 100.

Figure 2:
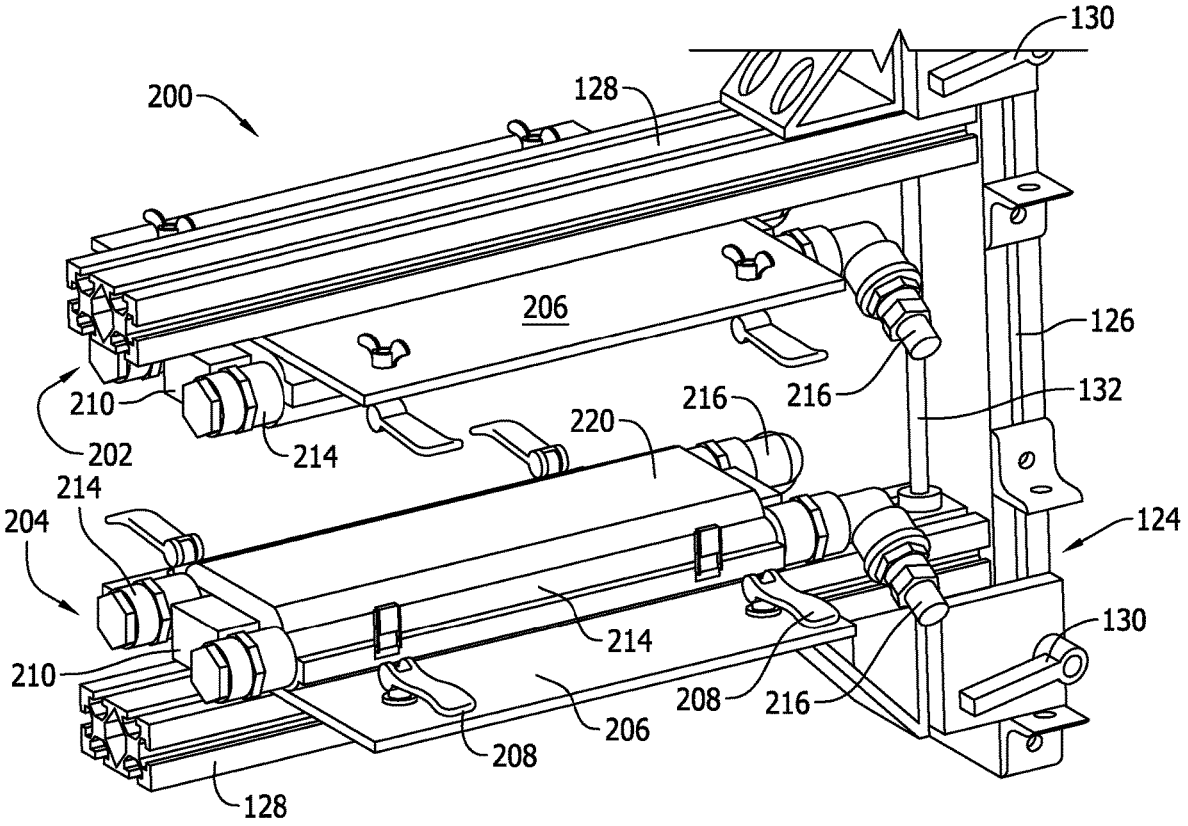
FIG. 2 is a perspective view of an exemplary pair of fluid applicators for use with the fluid application system shown in FIG. 1.
Figure 3:
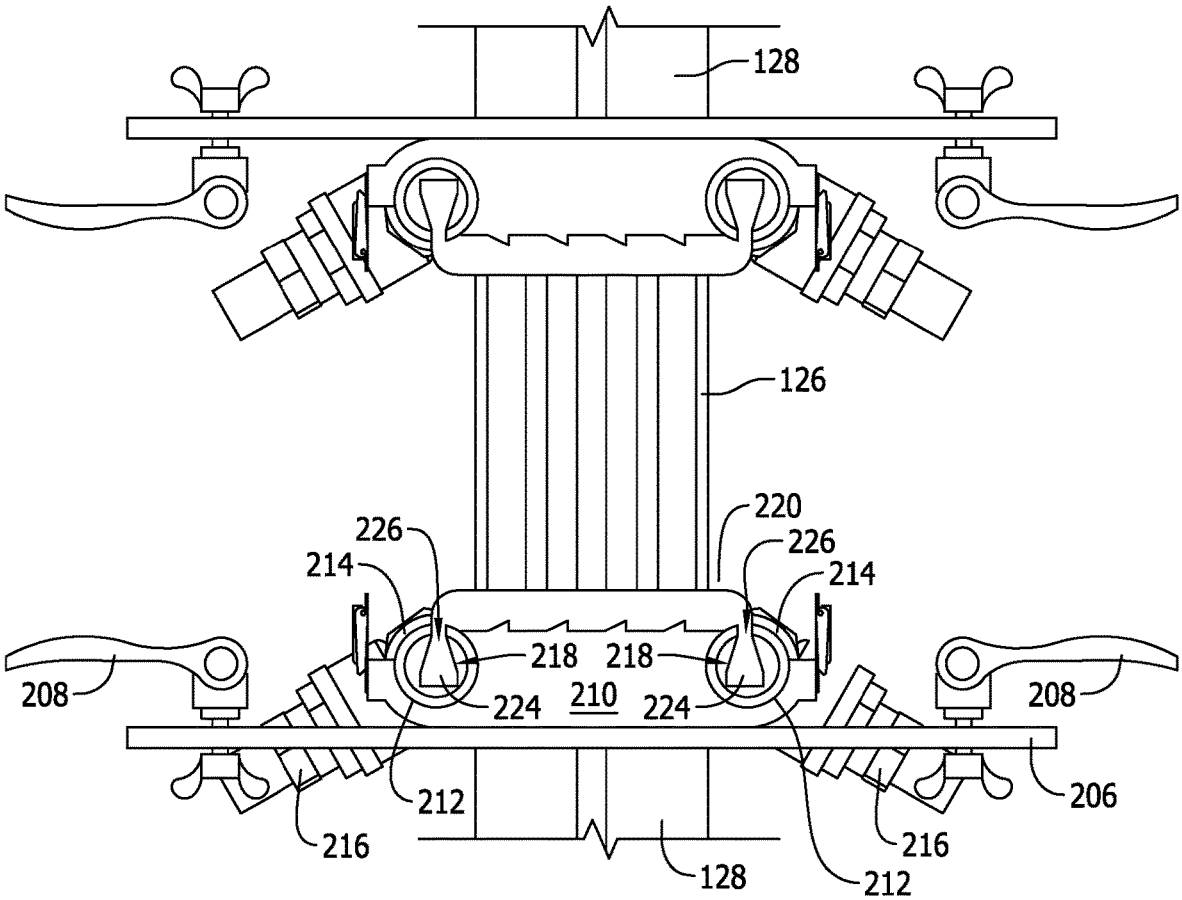
FIG. 3 is a cross-sectional view of the pair of fluid applicators shown in FIG. 2.
Figure 4:
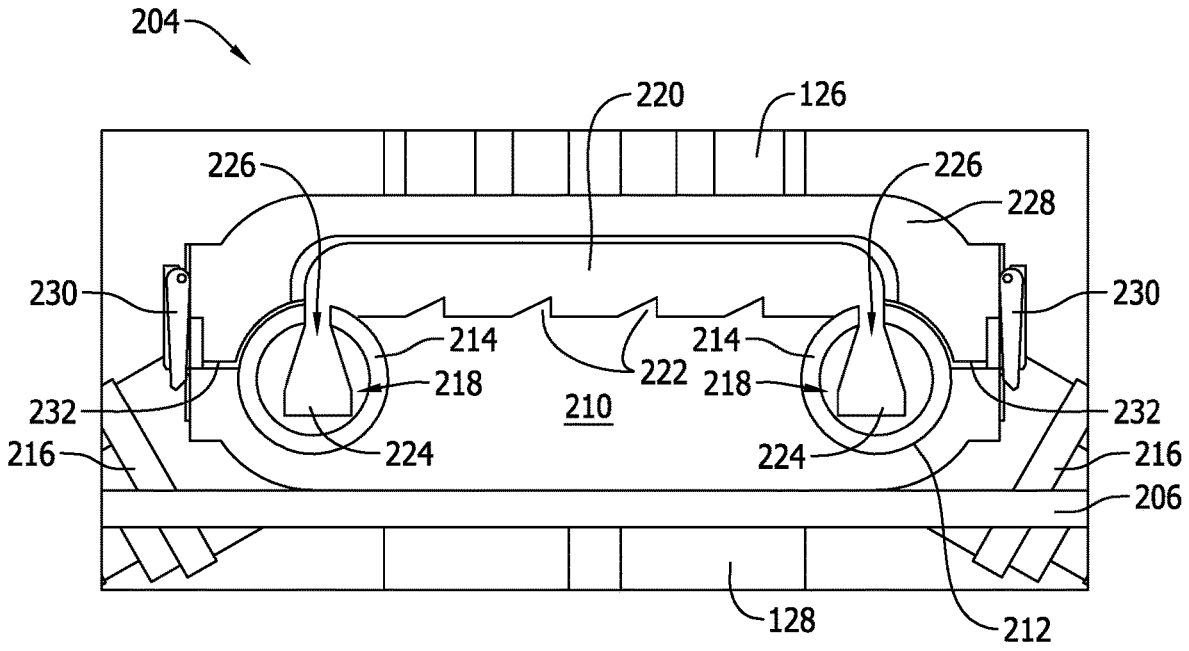
FIG. 4 is an enlarged cross-sectional view of one of the pair of fluid applicators shown in FIG. 3.

FIG. 2 is a perspective view of an exemplary pair of fluid applicators 200 for use with the fluid application system 100 (shown in FIG. 1) including a first fluid applicator 202 and a second fluid applicator 204. FIG. 3 is a cross-sectional view of fluid applicators 200, and FIG. 4 is an enlarged cross-sectional view of second fluid applicator 204. In the exemplary implementation, application system 100 also includes a rail system 124 including a vertical guide rail 126 and a pair of horizontal support rails 128 coupled to a corresponding fluid applicator 200. Each support rail 128, and therefore each fluid applicator 200, is moveable along guide rail 126 to adjust the distance between fluid applicators 200 to correspond to a thickness of work piece 108 to be received between fluid applicators 200. More specifically, as shown in FIG. 2, rail system 124 includes a pair of adjustment mechanisms 130 coupled to guide rail 126 and one support rail 128. Adjustment mechanisms 130 enable each support rail 128, and therefore each fluid applicator 200 to be moved independently and also secure each fluid applicator 200 in place along guide rail 126 after a desired position of each fluid applicator 200 is achieved. Furthermore, rail system 124 includes a biasing mechanism 132 coupled to at least one of the pair of support rails 128. Biasing mechanism 132 biases fluid applicators 200 toward one another and allows for fluid applicators 200 to follow a contour of a curved workpiece and/or workpieces of varying thickness.

In the exemplary implementation, each fluid applicator 200 includes a support plate 206 coupled to a respective support rail 128. Support plate 206 includes a plurality of securing mechanisms 208 for securing a sheet of sacrificial fabric 209 onto fluid applicators 200. Each fluid applicator 200 also includes a base plate 210 coupled to support plate 206. Baseplate 210 includes a pair of parallel grooves 212 defined therein that each receive a fluid delivery conduit 214. Each fluid delivery conduit 214 includes an inlet end 216 that is angled downward and configured to couple to a respective one of second fluid supply conduits 114 or 116 (both shown in FIG. 1). A cavity 218 is defined in each fluid delivery conduit 214 for storing an amount of fluid channeled from one of second fluid supply conduits 114 or 116 through inlet end 216.

Each fluid applicator 200 also includes a fluid permeable pad 220 coupled to base plate 210. More specifically, base plate 210 includes a plurality of protrusions 222 that extend from a surface of base plate 210 to prevent fluid permeable pad 220 from slipping as workpiece 108 (shown in FIG. 1) is slid across applicators 200. In the exemplary embodiment, fluid permeable pad 220 includes a sponge or a foam having a pair of opposing ends 224 that extend through a slot 226 defined in fluid delivery conduits 214 and terminate within cavity 218. Alternatively, fluid permeable pads 220 may be any material that retains a fluid and releases the fluid under pressure. Fluid delivery conduits 214 are arranged in a parallel, spaced-apart manner so as to be aligned with corresponding opposite ends 224 of fluid permeable pad 220.

When applicators 200 are not in use, a cover 228 is positioned over fluid permeable pad 220 and secured in place using a plurality of latching mechanisms 230 coupled between cover 228 and base plate 210. Furthermore, a gasket 232 extends about a perimeter of cover 228 and blocks air from reaching fluid permeable pad 220 to prevent evaporation of any fluid within fluid permeable pad 220. Cover 228 is removably coupled to base plate 210 and covers fluid permeable pad 220 to inhibit evaporation of fluid present in fluid permeable pad 220 when said cover 228 is coupled to base plate 210 during periods of non-use.

In operation, fluid is channeled through inlet ends 216 and into cavities 218 of fluid delivery conduits 214. Ends 224 of fluid permeable pad 220 are submerged in the fluid within cavities 218 and capillary action causes the fluid to permeate through substantially all of fluid permeable pad 220. Fabric sheet 209 is positioned over, that is, removably coupled to, fluid permeable pad 220 to protect pad from abrasion from workpiece 108 and is secured to support plate 206 using securing mechanisms 208. Fabric sheet 209 soaks up fluid from fluid permeable pad 220 and contacts workpiece 108 to apply the fluid to workpiece 108 as it is passed through application system 100 between fluid applicators 200.

Figure 5:
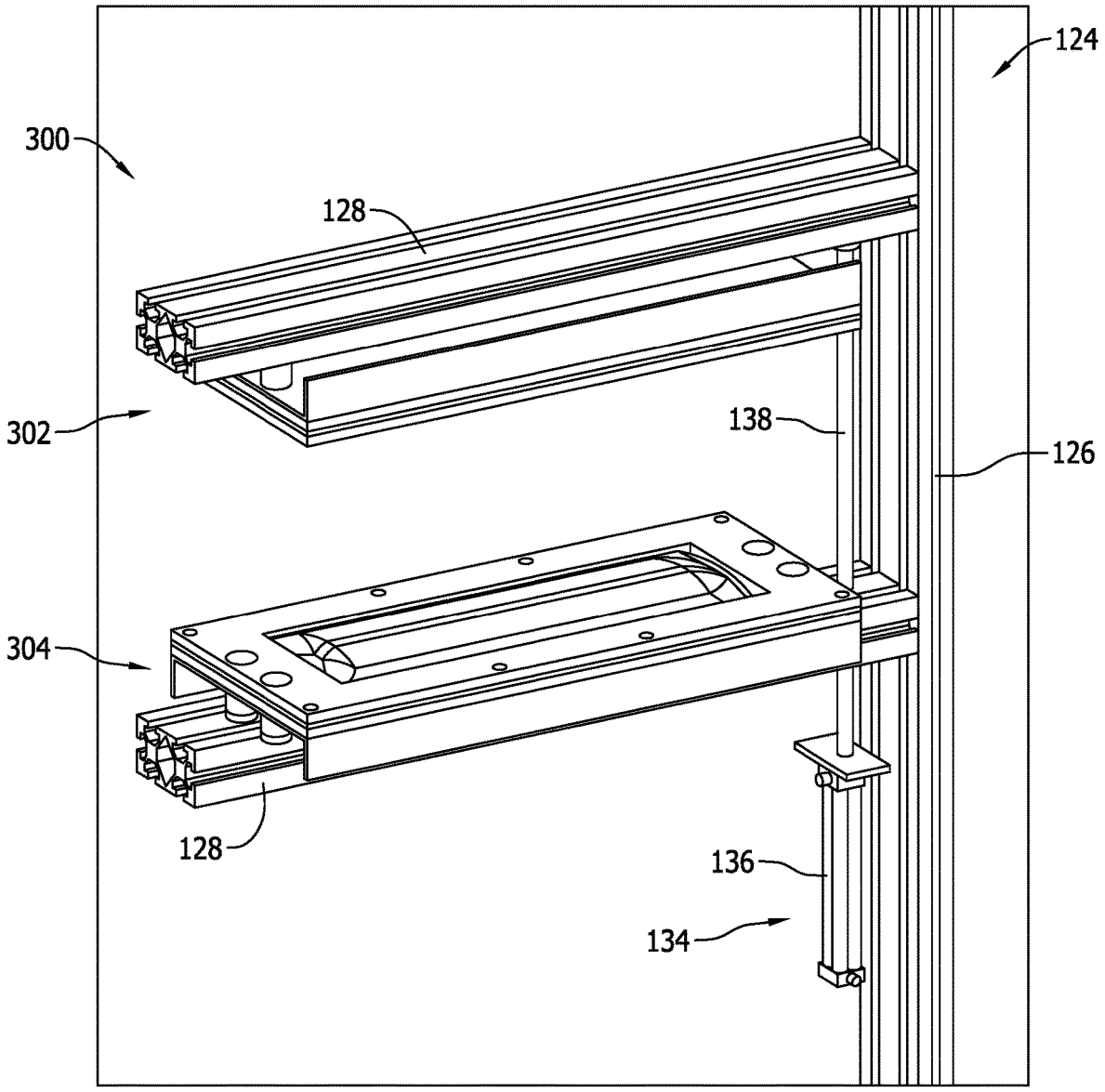
FIG. 5 is a perspective view of an alternative pair of fluid applicators for use with the fluid application system shown in FIG. 1.

FIG. 5 is a perspective view of an alternative pair of fluid applicators 300 for use with fluid application system 100 (shown in FIG. 1) including a first fluid applicator 302 and a second fluid applicator 304. As shown in FIG. 5, rail system 124 includes vertical guide rail 126 and horizontal support rails 128 coupled to a corresponding fluid applicator 300. Support rail 128 coupled to first fluid applicator 302 is moveable along guide rail 126 to adjust the distance between fluid applicators 300. More specifically, rail system 124 includes an actuator 134 including a housing 136 coupled to guide rail 126 and a moveable rod 138 coupled between housing 136 and first fluid applicator 302. Alternatively, housing 136 may be coupled to support rail 128 of second fluid applicator 304. Generally, housing 136 and rod 138 of actuator 134 may be coupled to any of the pair of support rails 128 or guide rail 126 to facilitate operation of actuator 134 as described herein. In operation, actuator 134 controls the distance between support rails 128, which controls the distance between fluid applicators 300. Furthermore, actuator 134 controls the amount of squeeze force fluid applicators 300 apply to workpiece 108 (shown in FIG. 1) to control an amount of fluid applied to workpiece 108. Although fluid applicators 300 are shown as used with actuator 134, fluid applicators 300 may also be used with adjustment mechanisms 130 and biasing mechanism 132 (both shown in FIG. 1). Similarly, fluid applicators 200 may be used with actuator 134 rather than adjustment mechanisms 130.

Figure 6:
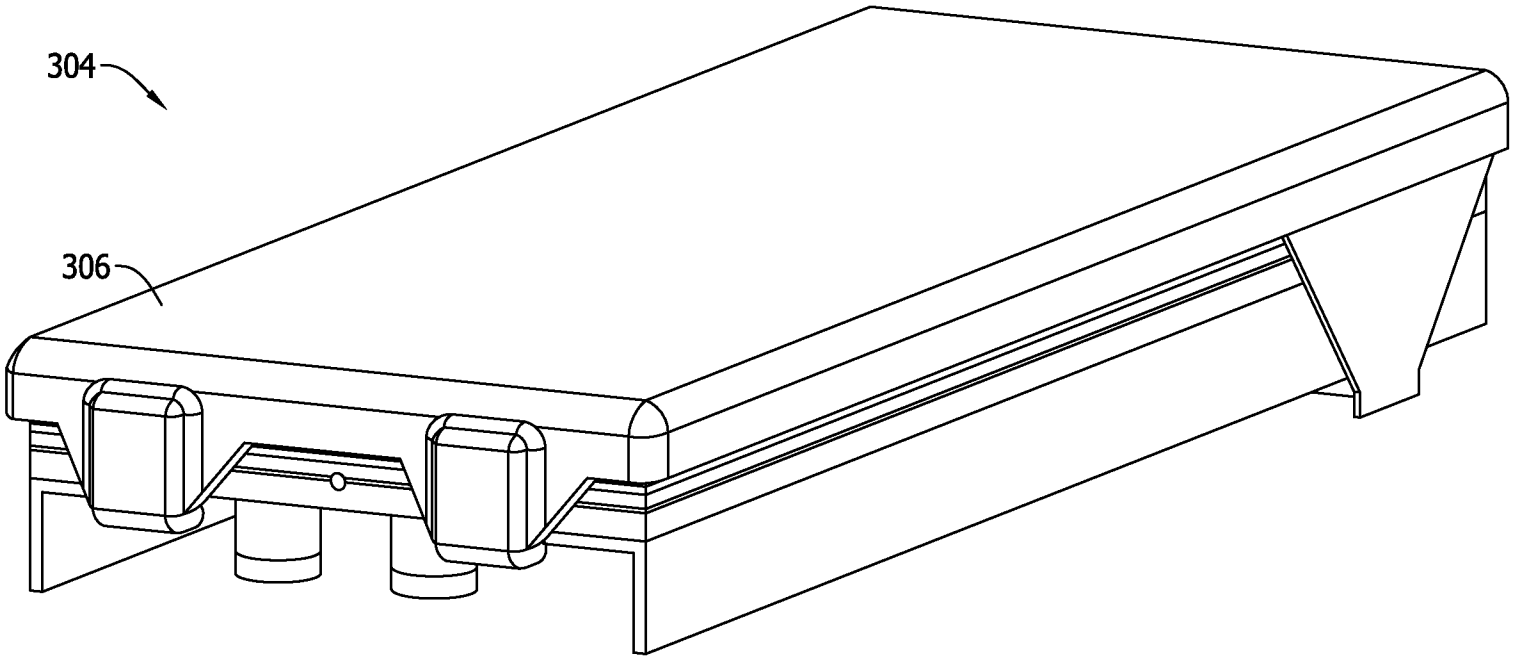
FIG. 6 is a perspective view of one fluid applicator, including a cover, of the pair of fluid applicators shown in FIG. 5.
Figure 7:
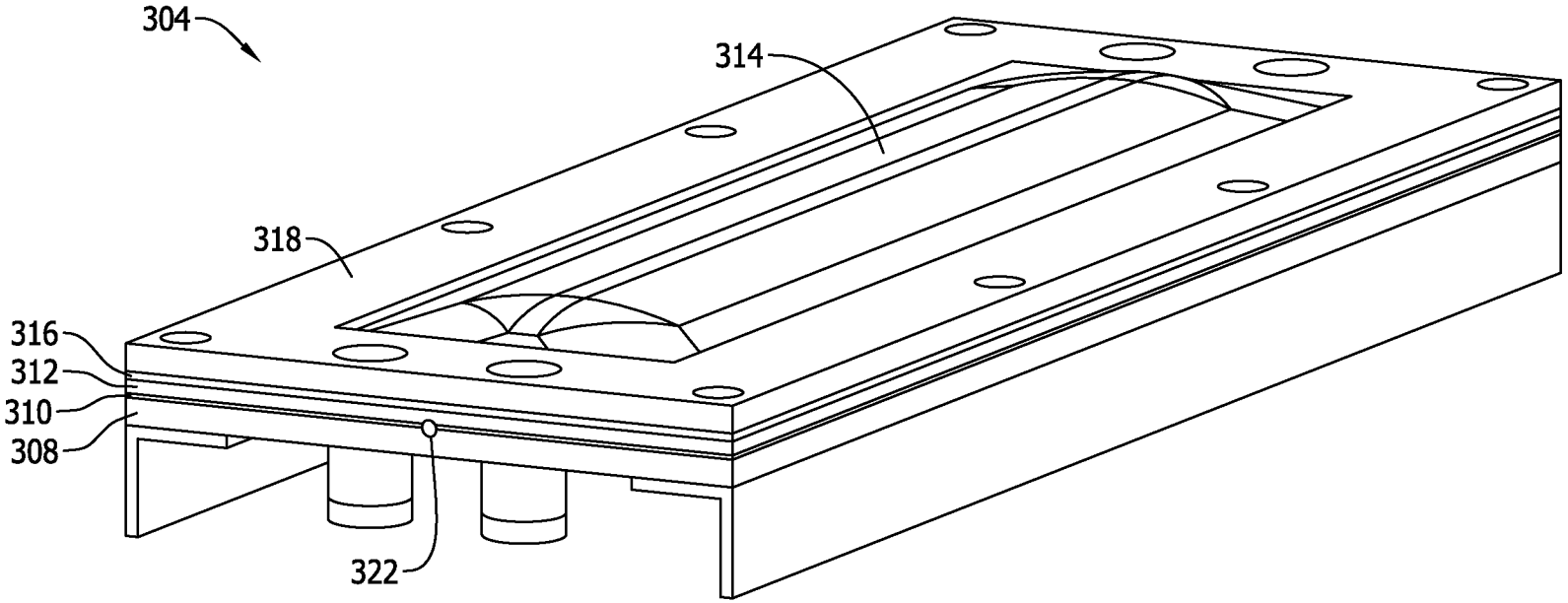
FIG. 7 is a perspective view of one fluid applicator, without the cover, of the pair of fluid applicators shown in FIG. 5.
Figure 8:
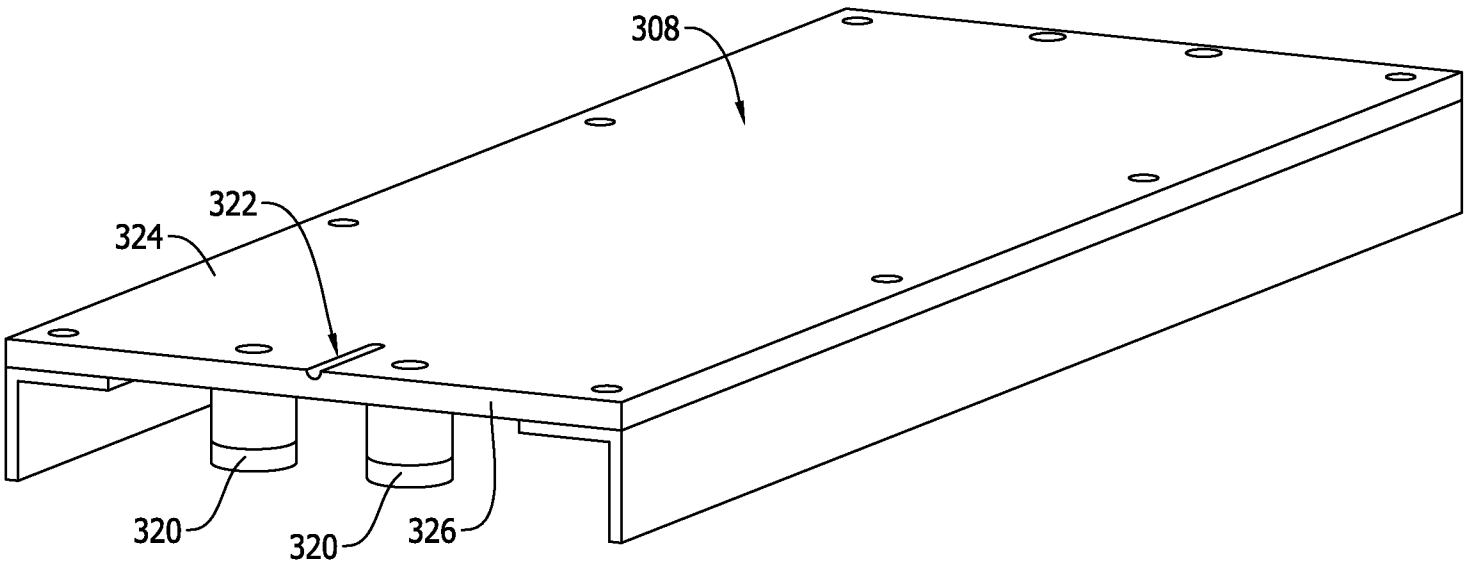
FIG. 8 is a perspective view of one fluid applicator, partially assembled, of the pair of fluid applicators shown in FIG. 5.

FIG. 6 is a perspective view of second fluid applicator 304 including a cover 306, and FIG. 7 is a perspective view of second fluid applicator 304 without cover 306 and illustrating a baseplate 308, a first gasket 310, a baffle plate 312, a fluid permeable pad 314, a second gasket 316, and a top plate 318. FIGS. 8-11 illustrate second fluid applicator 304 in various partially assembled states. FIG. 12 is an enlarged cross-sectional view of fully assembled second fluid applicator 304. Although only second fluid applicator 304 is described in detail herein, first fluid applicator 302 is substantially similar to second fluid applicator 304 and includes the same components and configuration. Similar to cover 228 above, 306 is removably coupled to base plate 308 and is configured to cover fluid permeable pad 314 to inhibit evaporation of fluid present in fluid permeable pad 314 during periods of non-use.

In the exemplary implementation, second fluid applicator 304 includes a plurality of coupling mechanisms 320 that couple support rail 128 to base plate 308 of second fluid applicator 304. Base plate 308 also includes a fluid inlet opening 322, best shown in FIG. 8, formed in an end of base plate 308 nearest to guide rail 126. Fluid inlet opening 322 receives a fluid delivery tube (not shown) that channels fluid from second secondary fluid conduit 116 (shown in FIG. 1) into second fluid applicator 304. In the exemplary implementation, fluid inlet opening 322 is a groove defined in a surface 324 and extends only partially into base plate 308 from an end surface 326.

Figure 9:
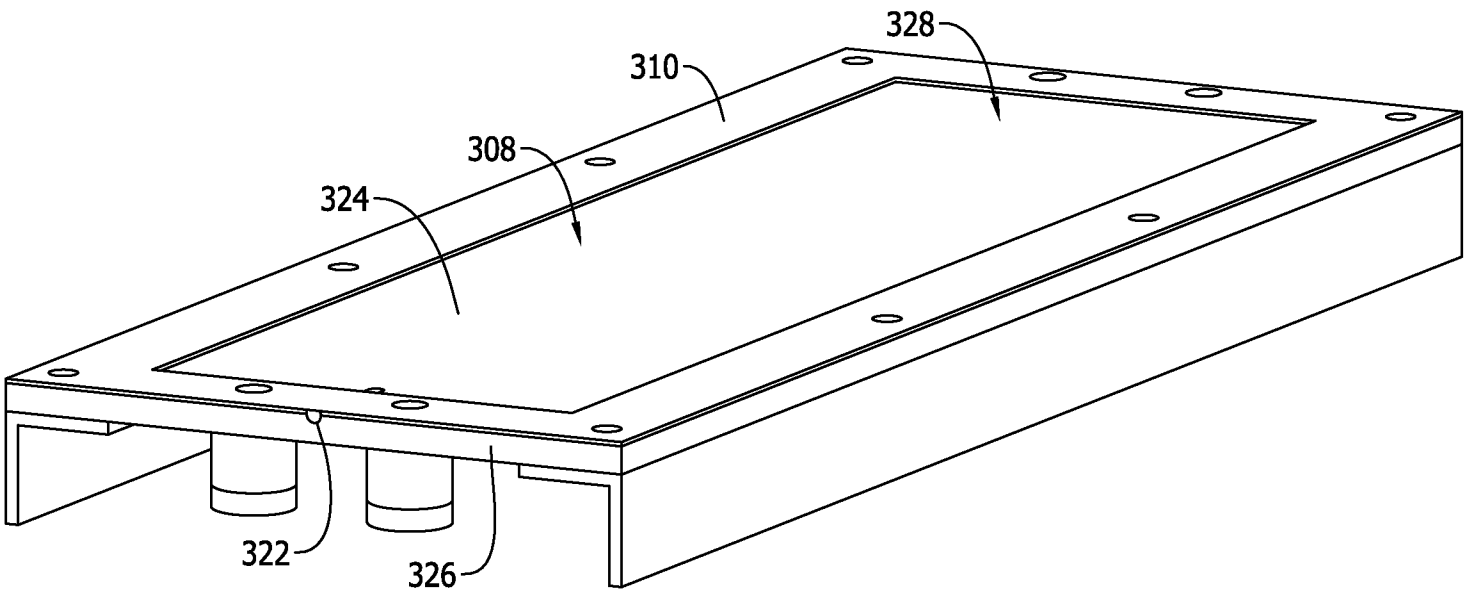
FIG. 9 is a perspective view of one fluid applicator, partially assembled, of the pair of fluid applicators shown in FIG. 5.

As shown in FIG. 9, second fluid applicator 304 also includes first gasket 310 coupled to surface 324 of base plate 308. In the exemplary implementation, first gasket 310 extends about a perimeter of base plate 308 and includes a central opening 328 such that first gasket 310 forms a border around the outer edges of base plate 308. First gasket 310 also includes a thickness that extends away from surface 324 such that first gasket 310 at least partially forms a fluid reservoir 330 in central opening 328 that has the same thickness of first gasket 310. Fluid inlet opening 322 extends a sufficient length from end surface 326 beyond first gasket 310 such that opposing ends of fluid inlet opening 322 couple fluid reservoir 330 in fluid communication with the fluid delivery conduit.

Figure 10:
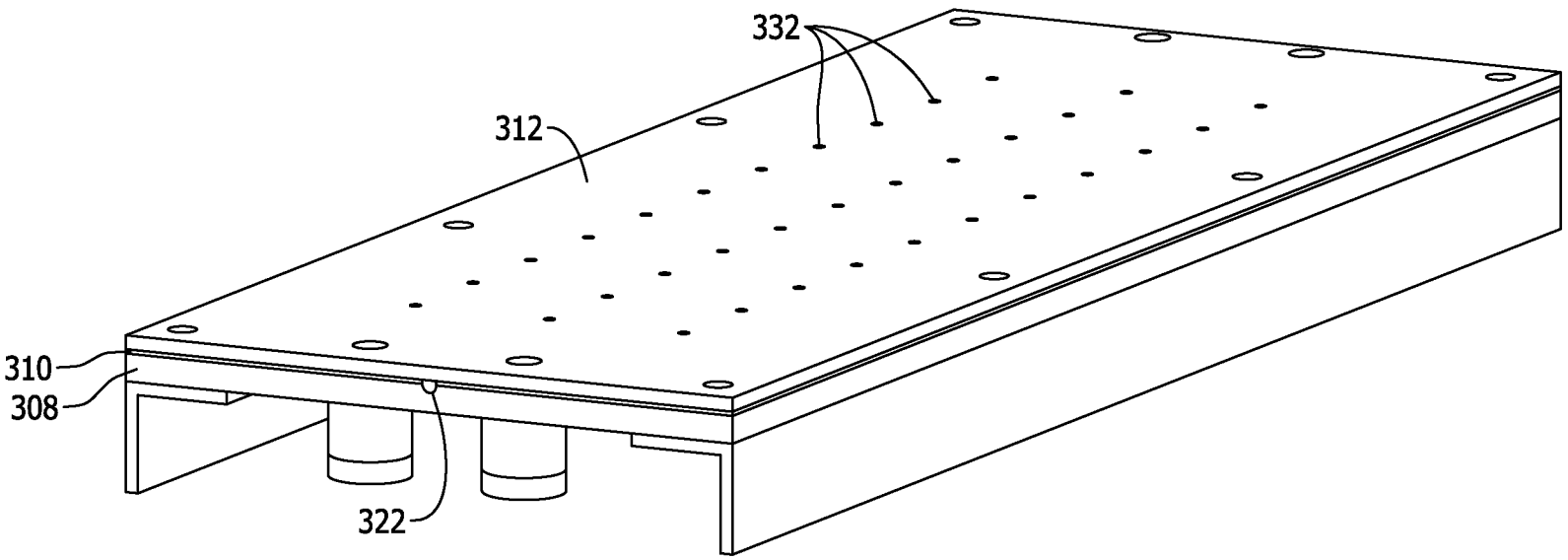
FIG. 10 is a perspective view of one fluid applicator, partially assembled, of the pair of fluid applicators shown in FIG. 5.
Figure 11:
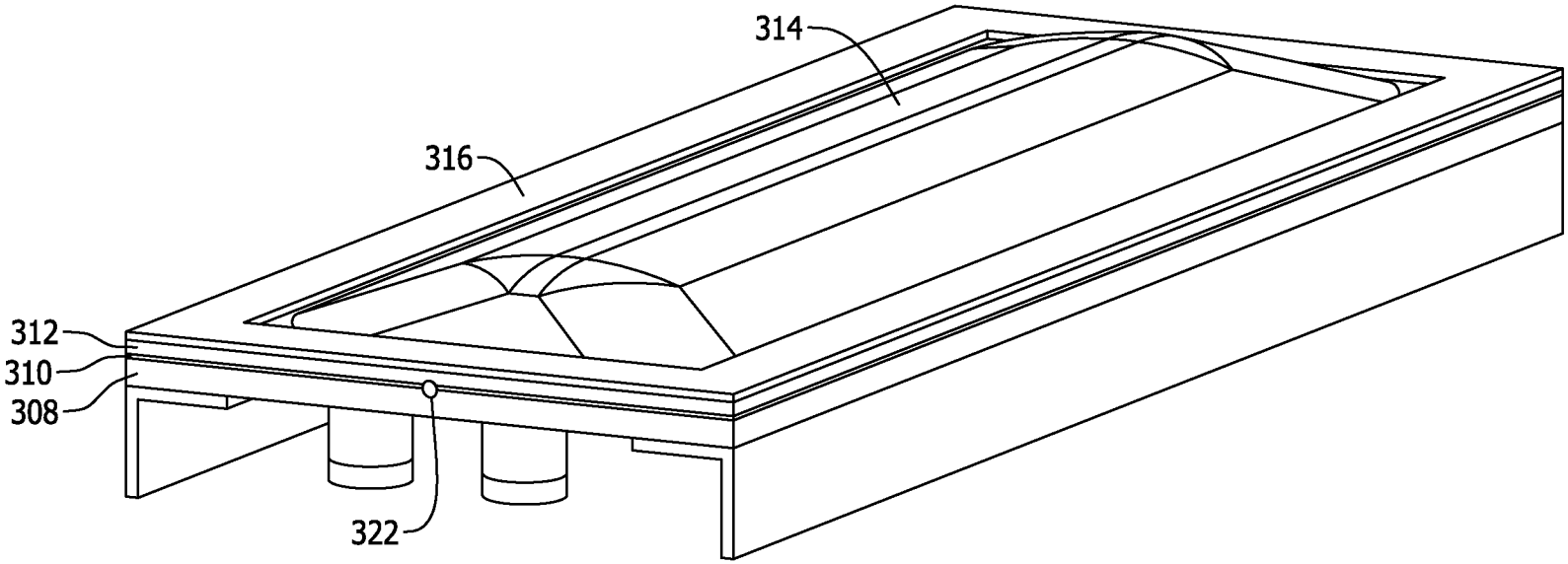
FIG. 11 is a perspective view of one fluid applicator, partially assembled, of the pair of fluid applicators shown in FIG. 5.
Figure 12:
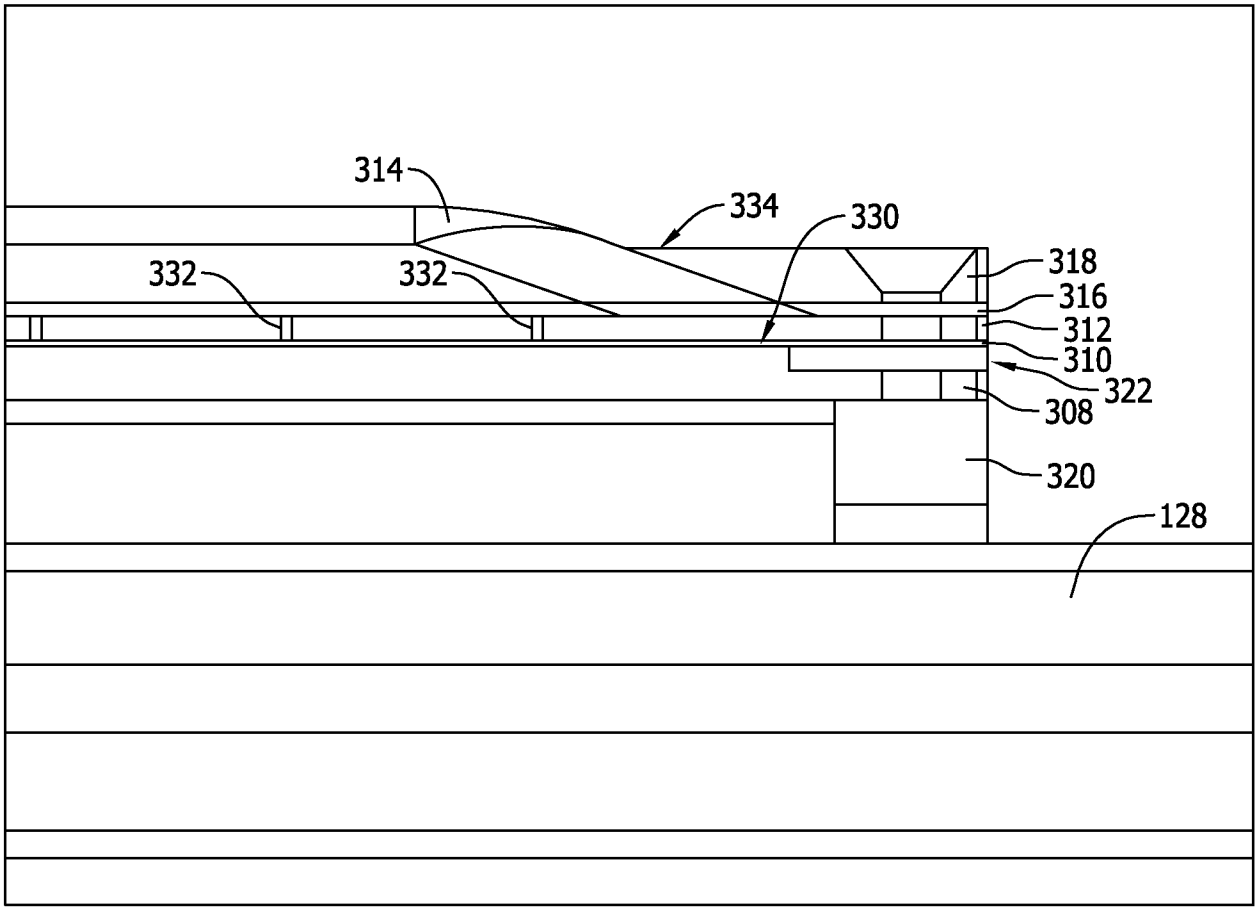
FIG. 12 is an enlarged cross-sectional view of one fluid applicator of the pair of fluid applicators shown in FIG. 5.

As shown in FIGS. 10-12, second fluid applicator 304 also includes baffle plate 312 coupled to first gasket 310. In the exemplary implementation, baffle plate 312 is substantially similar in size and shape as base plate 308 such that baffle plate 312 at least partially forms fluid reservoir 330. More specifically, fluid reservoir 330 is bounded on its sides by first gasket 310 and on top and bottom by base plate 308 and baffle plate 312. In the exemplary implementation, baffle plate 312 includes a plurality of openings 332 defined therethrough that are each in flow communication with fluid reservoir 330. Openings 332 are sized and distributed in baffle plate 312 such that fluid flows evenly from fluid reservoir 330, through openings 332, and into fluid permeable pad 314. More specifically, openings 332 are sized and distributed such that a substantially similar amount of fluid is channeled through openings 332 nearest to fluid inlet opening 322 as is channeled through openings 332 furthest from fluid inlet opening 322. Although openings 332 are illustrated in FIG. 10 as being of a similar size and an evenly-spaced distribution, openings 332 may have different sizes based on a location on baffle plate 312. Similarly, the distribution of openings 332 in baffle plate 312 may different based on a distance from fluid inlet opening 322.

In the exemplary implementation, fluid permeable pad 314 is positioned on baffle plate 312 opposite fluid reservoir 330, and second gasket 316 is coupled to baffle plate 312 around the outer edges of fluid permeable pad 314, as best shown in FIG. 11. Accordingly, fluid permeable pad 314 is sized smaller than base plate 308 and baffle plate 312 to enable second gasket 316 to extend around fluid permeable pad 314. Top plate 318 is then coupled to second gasket 316. As shown in FIGS. 7 and 12, top plate 318 includes a center opening 334 through which a portion of fluid permeable pad 314 protrudes such that fluid permeable pad 314 is the high point of fluid applicator 304.

In operation, fluid is channeled through fluid inlet opening 322 of base plate 308 and into fluid reservoir 330 defined between base plate 308, baffle plate 312, and first gasket 310. As additional fluid is channeled into reservoir, the fluid flows through openings 332 in baffle plate 312 and into fluid permeable pad 314. Pad 314 soaks up the fluid through capillary action, and the fluid is transferred to a sacrificial fabric positioned over fluid permeable pad 314 to protect pad 314 from wear. The fabric soaks up fluid from fluid permeable pad 314 and contacts workpiece 108 to apply the fluid to workpiece 108 as it is passed through application system 100 between fluid applicators 300.

Figure 13:
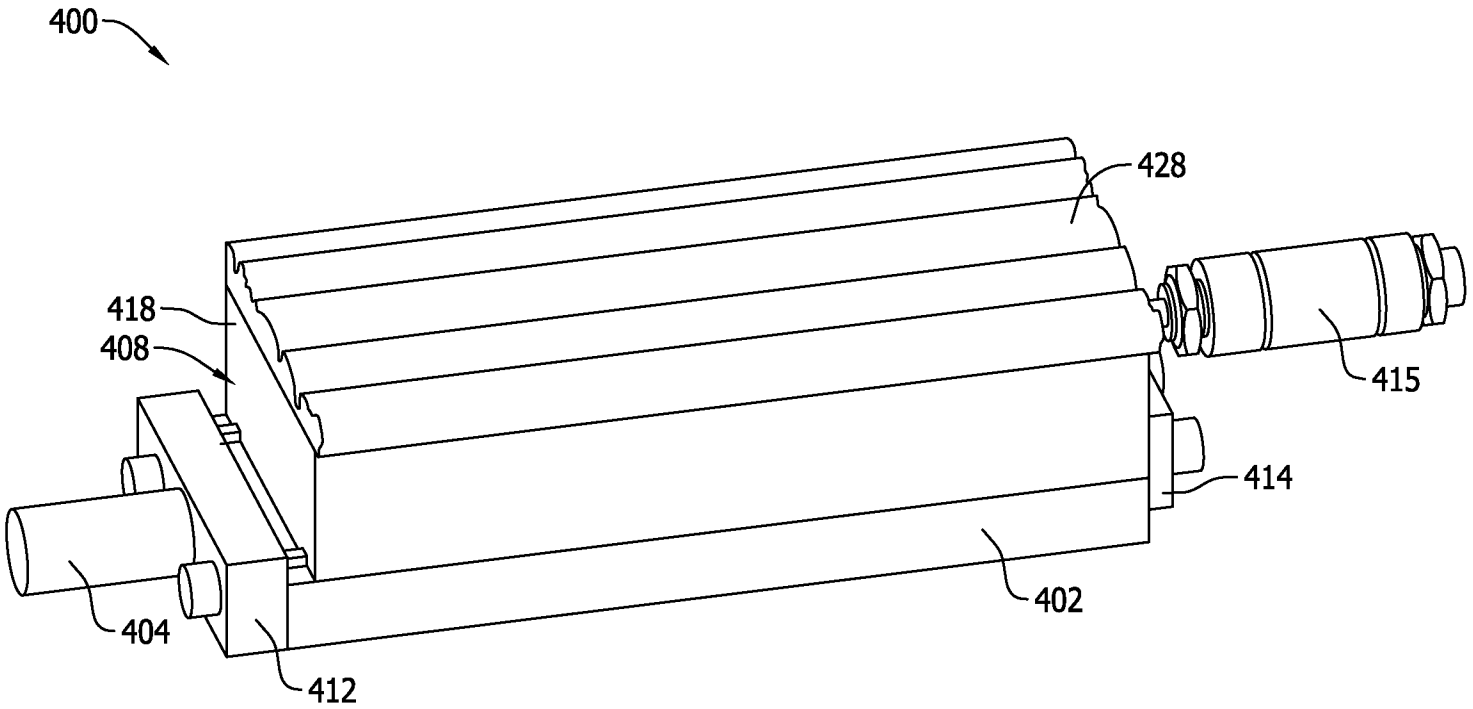
FIG. 13 is a perspective view of one of another alternative pair of fluid applicators for use with the fluid application system shown in FIG. 1.
Figure 14:
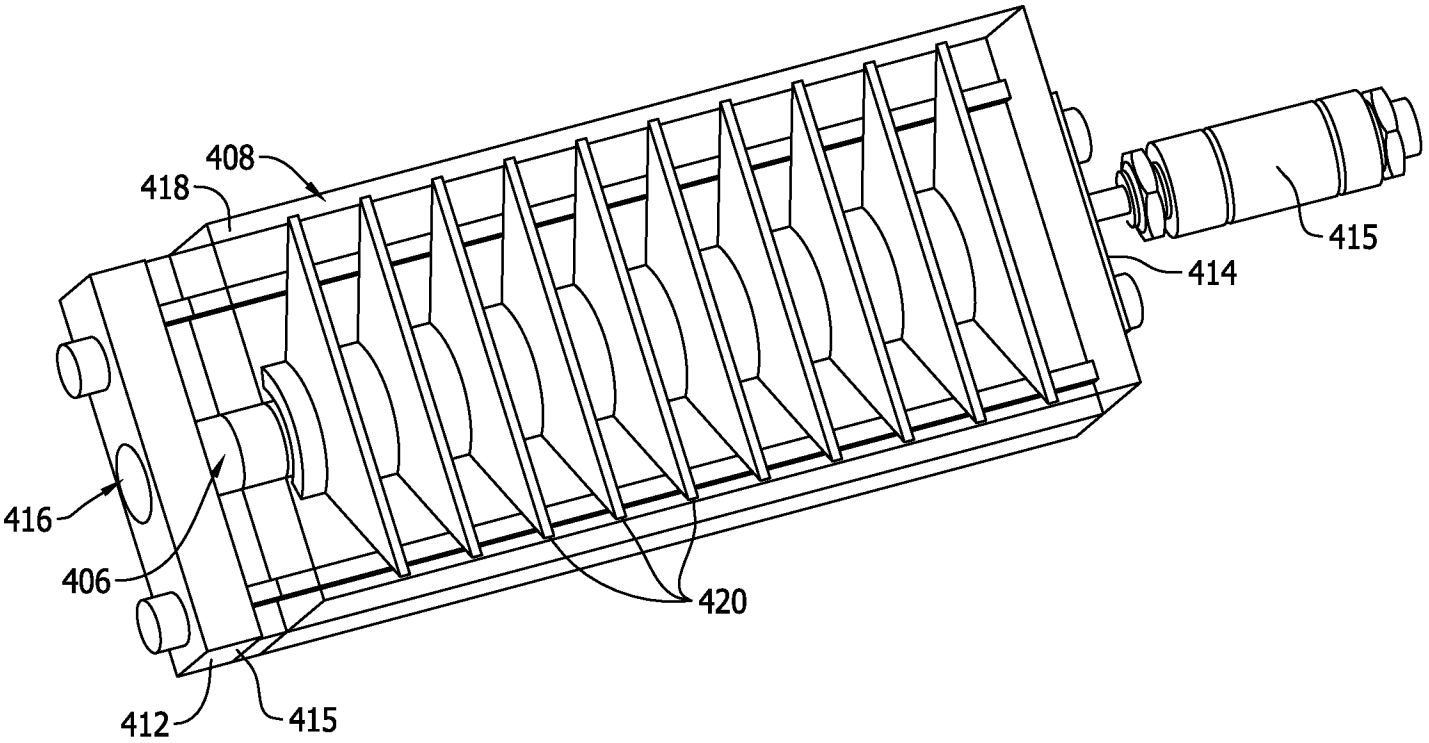
FIG. 14 is a perspective top view of the fluid applicator shown in FIG. 13 illustrating a plurality of fluid permeable pads as seen in a partially translucent housing.
Figure 15:
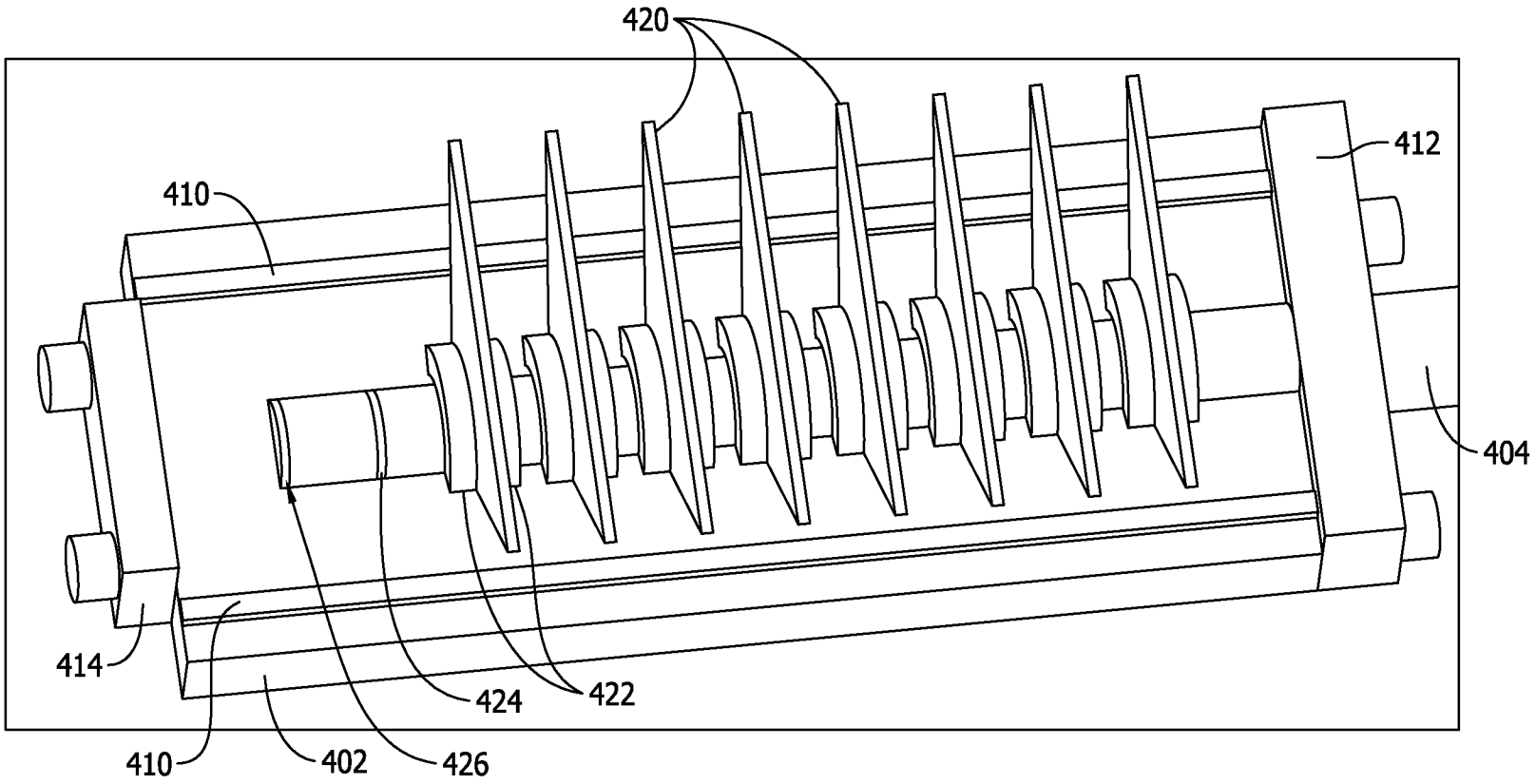
FIG. 15 is a perspective top view of the fluid applicator shown in FIG. 13 illustrating a plurality of fluid permeable pads with a number of components removed for clarity.

FIG. 13 is a perspective view of one of another alternative pair of fluid applicators 400 for use with fluid application system 100 (shown in FIG. 1). Only a single fluid applicator 400 is shown and described, but the pair are identical, as with fluid applicators 200 and 300. Although not shown in FIG. 13, fluid applicators 400 are coupled to rail system 124 (shown in FIG. 1) in a similar manner as either fluid applicators 200 or 300. FIG. 14 is a perspective top view of fluid applicator 400 shown in FIG. 13 illustrating a plurality of fluid permeable pads 420 as seen in a partially translucent housing 408. FIG. 15 is a perspective top view of fluid applicator 400 illustrating the plurality of fluid permeable pads 420 with a number of other components removed for clarity.

In the exemplary implementation, fluid applicator 400 includes a stationary base plate 402 and a fluid delivery conduit 404 positioned in a groove 406 formed in a top surface of the base plate 402. Fluid applicator 400 also includes a housing 408 that is slidable along a pair of rails 410 on base plate 402 between a first position and a second position. A first end plate 412 is coupled to a first end of base plate 402, and an opposing second end plate 414 is coupled at an opposing second end of base plate 402. End plates 412 and 414 act as stoppers to define a range of motion for housing 408 as it slides along rails 410 on base plate 402. First end plate 412 also includes an opening 416 that is aligned with groove 406 in base plate 402 to enable fluid delivery conduit 404 to extend through opening 416 and into groove 406.

As shown in FIGS. 13 and 14, an actuation mechanism 415 is coupled to housing 408 such that actuation mechanism 415 moves housing 408, including fluid permeable pads 420, between the first position and the second position. In one implementation, actuation mechanism 415 is a pneumatic mechanism. In another implementation, actuation mechanism 415 is a mechanical mechanism. Generally, actuation mechanism 415 is any mechanism that facilitates operation of fluid applicator 400 as described herein. Although actuation mechanism 415 is illustrated in FIGS. 13 and 14 as extending from an opposing end of fluid applicator 400 as fluid delivery conduit 404, actuation mechanism 415 and fluid delivery conduit 404 may extend from the same side of fluid applicator 400.

In the exemplary implementation, housing 408 includes a body portion 418 that houses a plurality of fluid permeable pads 420 and a plurality of gaskets 422. Body portion 418 is shown as partially translucent in FIGS. 13 and 14 and is removed from FIG. 15 to more clearly illustrate fluid delivery conduit 404, fluid permeable pads 420, and gaskets 422. In a real world embodiment, body portion 418 is opaque and only a top surface of fluid permeable pads 420 would be visible as the top surface of fluid permeable pads 420 is substantially flush with, or extends slightly beyond, a top surface of body portion 418. As shown in FIGS. 13 and 14, body portion 418 is a single piece that slides along base plate 402 between end plates 412 and 414.

As shown in FIG. 15, where two fluid permeable pads 420 and their corresponding gaskets 422 have been removed for clarity, fluid delivery conduit 404 includes a plurality of openings or slots 424 defined therein. Each slot 424 is associated with a corresponding fluid permeable pad 420 such that fluid permeable pads 420 are selectively in fluid communication with the fluid within a cavity 426 of fluid delivery conduit 404 through slots 424. More specifically, in the first position, fluid permeable pads 420 are misaligned with slots 426 such that one gasket 422 of the pair of gaskets 422 on opposing sides of each fluid permeable pad 420 is aligned with a slot 424. In such a configuration, fluid flow from cavity 426 of fluid delivery conduit 404 to the plurality of fluid permeable pads 420 is prevented. In the second position, each fluid permeable pad 420 is aligned with a corresponding slot 424 to enable fluid flow through slots 424 from cavity 426 to fluid permeable pads 420.

In operation, fluid is channeled through one of secondary fluid conduits 114 or 116 (shown in FIG. 1) and into cavity 426 of fluid delivery conduit 404 of fluid applicator 400. Initially, when not in use, housing 408 is in the first position where gaskets 422 cover slots 424 in fluid delivery conduit 404 to block the flow of fluid from cavity 426 to fluid permeable pads 420. When operation of application system 100 is desired, actuation mechanism 415 is operated to slide housing 408, including fluid permeable pads 420 and gaskets 422, along rails 410 of base plate 402 to the second position. As described herein, when in the second position, fluid permeable pads 420 are aligned with slots 424 in fluid delivery conduit 404. The pressurization of storage tank 110 (shown in FIG. 1) channels fluid from cavity 426, through slots 424, and into fluid permeable pads 420. Capillary action enables the fluid to travel through fluid permeable pads 420 and transfer the fluid to a sacrificial fabric 428 positioned over fluid permeable pads 420 to protect pads 420 from wear. Fabric 428 soaks up fluid from fluid permeable pads 420 and contacts workpiece 108 to apply the fluid to workpiece 108 as it is passed through application system 100 between fluid applicators 400.

Figure 16:
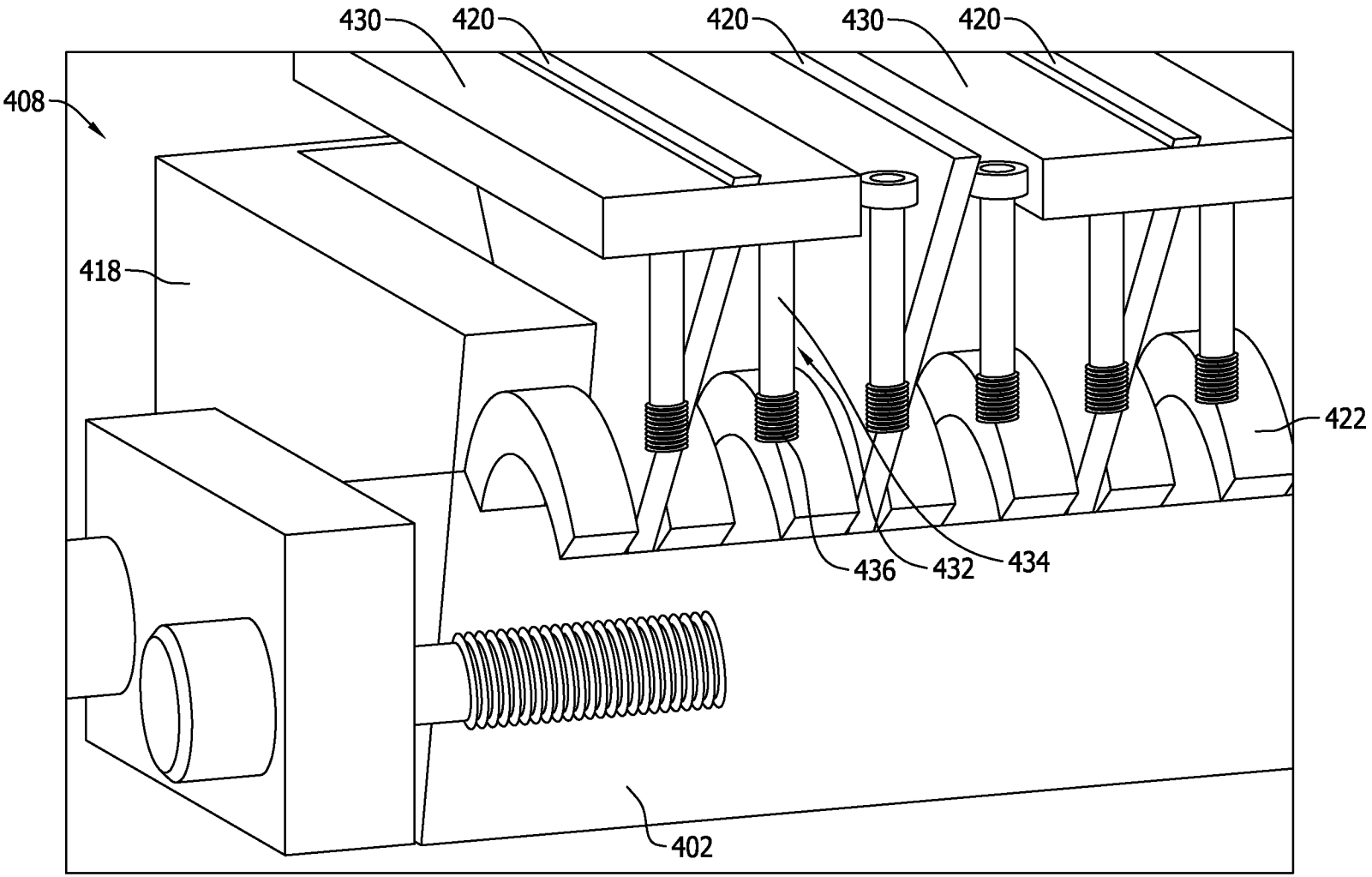
FIG. 16 is a perspective view of an alternative housing for use with the fluid applicator shown in FIG. 13 illustrating a plurality of housing segments.

FIG. 16 is a perspective view of an alternative housing 408 for use with fluid applicator 400 illustrating a plurality of housing segments 430. In the implementation, each segment 430 is associated with a corresponding fluid permeable pad 420 and is bias able with respect to body portion 418 of housing 408. More specifically, each segment 430 is coupled to body portion 418 via a plurality of biasing mechanisms 432. As shown in FIG. 16, biasing mechanisms 432 include a rod 434 and a spring 436 that bias segment 430 and fluid permeable pad 420 away from body portion 418. Alternatively, biasing mechanism 432 may be any type of device that facilitates operation of fluid applicator 400 and is not limited to a rod and spring.

Similar to FIGS. 13 and 14, portions of body portion 418 and base plate 402 are shown as partially translucent to enable viewing of inner components of fluid applicator 400. Additionally, one of segments 430 is removed to more clearly illustrate fluid permeable pads 420 and biasing mechanism 432. Each fluid permeable pad 420 is coupled to a segment 430 such that movement of segment 430 with respect to body portion 418 results in movement of the corresponding fluid permeable pad 420 in the same manner. Individually biasable segments 430 and fluid permeable pads 420 enable fluid permeable pads 420 to conform to a contour of workpiece 108 as workpiece 108 travels along and as such, enables fluid applicator 400 to apply fluid to workpieces 108 of varying shapes and profiles.

The examples described herein facilitate applying a fluid to a workpiece using a fluid permeable pad saturated with the fluid. The fluid application system described herein includes a pair of identical, spaced apart, fluid applicators that each include a fluid permeable pad saturated with the fluid. In one implementation, each of the fluid applicators also includes a pair of fluid delivery conduits coupled to a base plate, wherein each fluid delivery conduit includes a slot defined therein configured to receive an opposing end of the fluid permeable pad. In another embodiment, each fluid applicator defines a fluid reservoir between adjacent plates and channels fluid from the reservoir though openings in the plate to the fluid permeable pad. In yet another implementation, each of the fluid applicators includes a base plate, a fluid delivery conduit coupled to the base plate, and a housing slidably coupled to the base plate between a first position and a second position. The housing includes a plurality of fluid permeable pads and is moveable to selectively prevent fluid flow between the fluid delivery conduit and the plurality of fluid permeable pads in the first position or to couple the plurality of fluid permeable pads in fluid communication with the fluid delivery conduit in the second position.

Additionally, the fluid application systems described herein do not channel the fluid through any pumps or valves, which enables the use of volatile and/or corrosive fluids without the risk of causing corrosion and/or creating a potential source of ignition in the pump or valve. Moreover, in the systems described herein application of the fluid to the workpiece does not require a technician to handle the fluid or to be near enough to breathe in the fluid vapors, thus providing a safer working environment.

Furthermore, in operation, the waste containment system includes at least one of the following technical effects: 1) reducing an amount of fluid waste by capturing unused fluid and channeling it to a storage tank; 2) increases the safety of the manufacturing facility by pressurizing a storage tank and not channeling the fluid through pumps or valves; and 3) facilitates hands-free application of fluid to the workpiece to prevent exposing a technician to the potentially harmful fluid or vapors.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fluid applicator for use in a fluid application system, the fluid applicator comprising:

a base plate comprising at least one rail;

a housing slidably coupled to the base plate;

a plurality of fluid permeable pads positioned within the housing;

a fluid delivery conduit coupled to the base plate and to the housing; and an actuator configured to selectively move the housing and the plurality of pads along the rails between a first position and a second position, wherein the plurality of fluid permeable pads are in flow communication with the fluid delivery conduit in the first position, and wherein the plurality of fluid permeable pads are prevented from being in flow communication with the fluid delivery conduit in the second position.

2. The fluid applicator of claim 1, further comprising a first end plate coupled to a first end of the base plate and a second end plate coupled to a second end of the base plate, wherein the first end plate comprises an opening to receive the fluid delivery conduit.

3. The fluid applicator of claim 2, wherein the actuator is coupled to one of the first end plate or the second end plate.

4. The fluid applicator of claim 2, wherein the first end plate and the second end plate define a range of movement of the housing along the base plate.

5. The fluid applicator of claim 1, further comprising a pair of gaskets positioned on opposite sides of each pad of the plurality of fluid permeable pads.

6. The fluid applicator of claim 5, wherein the fluid delivery conduit comprises a plurality of slots, and wherein each fluid permeable pad is aligned with a respective slot in the first position.

7. The fluid applicator of claim 6, wherein one gasket of each pair of gaskets is aligned with a respective slot in the second position.

8. The fluid applicator of claim 1, wherein the housing comprises a plurality of biasable segments coupled to a respective corresponding fluid permeable pad of the plurality of fluid permeable pads.

9. The fluid applicator of claim 8, further comprising at least one biasing mechanism coupled to each biasable segment and configured to bias the corresponding biasable segment and fluid permeable pad away from the fluid delivery conduit.

10. A fluid application system, comprising:

a pair of fluid applicators including a first fluid applicator and a second fluid applicator, each of said fluid applicators comprising:

a base plate;

a fluid delivery conduit coupled to said base plate; and a housing slidably coupled to said base plate between a first position and a second position and comprising a plurality of fluid permeable pads, wherein said housing is selectively moveable to prevent fluid flow between said fluid delivery conduit and said plurality of fluid permeable pads in the first position and to couple said plurality of fluid permeable pads in fluid communication with said fluid delivery conduit in the second position; and a rail system comprising a guide rail, wherein said first fluid applicator and said second fluid applicator are slidably coupled to said guide rail such that said first fluid applicator and said second fluid applicator are movable relative to each other to adjustably vary a distance therebetween to correspond to a thickness of a workpiece configured to be received between said first fluid applicator and said second fluid applicator.

11. The system of claim 10, wherein said fluid delivery conduit comprises a cavity and plurality of slots defined therethrough, wherein each said fluid permeable pad is aligned with a corresponding slot of said plurality of slots when said housing is in the second position to enable fluid flow from said cavity into said fluid permeable pad.

12. The system of claim 11, wherein each said fluid permeable pad is misaligned with a corresponding slot of said plurality of slots when said housing is in the first position.

13. The system of claim 11, wherein each said fluid applicator further comprises a plurality of gaskets, wherein a gasket of said plurality of gaskets is aligned with a corresponding slot of said plurality of slots when said housing is in the first position.

14. The system of claim 10, wherein each said fluid applicator further comprises a first end plate coupled to a first end of said base plate and a second end plate coupled to an opposing end of said base plate, wherein said first end plate and said second end plate define a range of motion of said housing.

15. The system of claim 14, wherein said fluid delivery conduit extends through an opening defined in said first end plate and is coupled within a groove defined in said base plate.

* * * * *